US008474220B2

(12) United States Patent
Svensson

(10) Patent No.: US 8,474,220 B2
(45) Date of Patent: Jul. 2, 2013

(54) PREMANUFACTURED ROOF PLATE ELEMENT

(76) Inventor: Peehr Mathias Ørnfeldt Svensson, Skanderborg (DK)

( * ) Notice: Subject to any disclaimer, the term of this patent is extended or adjusted under 35 U.S.C. 154(b) by 164 days.

(21) Appl. No.: 12/595,832

(22) PCT Filed: Apr. 15, 2008

(86) PCT No.: PCT/DK2008/000132

§ 371 (c)(1),
(2), (4) Date: Nov. 10, 2009

(87) PCT Pub. No.: WO2008/125109

PCT Pub. Date: Oct. 23, 2008

(65) Prior Publication Data

US 2010/0115880 A1 May 13, 2010

(30) Foreign Application Priority Data

Apr. 16, 2007 (DK) ..... 2007 00554

(51) Int. Cl.
*E04C 3/00* (2006.01)

(52) U.S. Cl.
USPC ..... 52/840; 52/407.3; 52/479; 52/220.4; 52/839; 52/843

(58) Field of Classification Search
USPC ..... 52/409, 407.3, 800.12, 837, 839, 52/840, 408, 783.11, 479, 480, 180, 198, 52/220.4, 831, 843
See application file for complete search history.

(56) References Cited

U.S. PATENT DOCUMENTS

| | | | | |
|---|---|---|---|---|
| 3,102,611 | A * | 9/1963 | Mote | 52/783.15 |
| 3,267,626 | A | 8/1966 | Daly | |
| 4,125,977 | A * | 11/1978 | Michlovic | 52/220.4 |
| 4,441,291 | A | 4/1984 | Sokoler et al. | |
| 4,475,327 | A * | 10/1984 | O'Regan et al. | 52/404.1 |
| 4,918,897 | A * | 4/1990 | Luedtke | 52/742.14 |
| 4,993,095 | A * | 2/1991 | Lautensleger et al. | 14/74.5 |
| 5,048,257 | A * | 9/1991 | Luedtke | 52/747.1 |
| 5,050,362 | A * | 9/1991 | Tal et al. | 52/588.1 |
| 6,050,208 | A * | 4/2000 | Kennedy | 114/74 A |
| 6,321,504 | B1 * | 11/2001 | Svensson | 52/650.1 |
| 6,385,942 | B1 * | 5/2002 | Grossman et al. | 52/798.1 |
| 7,493,729 | B1 * | 2/2009 | Semmes | 52/79.1 |
| 7,540,123 | B1 * | 6/2009 | Semmes | 52/783.19 |

FOREIGN PATENT DOCUMENTS

| | | |
|---|---|---|
| GB | 1391472 A | 4/1975 |
| JP | 11-324208 | 11/1999 |

* cited by examiner

*Primary Examiner* — Joshua J Michener
*Assistant Examiner* — Chi Q Nguyen
(74) *Attorney, Agent, or Firm* — Antonelli, Terry, Stout & Kraus, LLP.

(57) ABSTRACT

A prefabricated roof plate element (4), including one or more longitudinal box-shaped girders (24), each having two predominantly U-shaped metal sections (10, 18) which at mutually facing, open sides are interconnected along narrow outwards bent lateral edges (5). The girders (24) are connected at upper and lower sides (19) corrugated in longitudinal direction which office corrugated metal plates (7) which are corrugated in a transverse direction and have approximately the same width as the roof plate element (4). The girders (24) are disposed along opposed sides and at a center of the roof plate element (4). One of the sections (10, 18) is shorter than another one of the sections to forming eaves (6).

32 Claims, 5 Drawing Sheets

PREMANUFACTURED ROOF PLATE ELEMENT

BACKGROUND OF THE INVENTION

1. Field of the Invention

The present invention concerns a prefabricated roof plate element.

2. Description of the Prior Art

Prefabricated roof plate elements may be produced of 100% inorganic materials, which have great significance for durability and maintenance. Besides, it is of great significance that the roof plate elements in question may have a free span of up to 22 meters, that is one single roof plate element may cover about 80 $m^2$, which of course has great significance with regard to reducing the building period.

SUMMARY OF THE INVENTION

The invention is an improved roof plate element, which by means of simple technical measures provides very substantial construction advantages, and which furthermore enables an architecturally very simple and light construction of the visible eave part of the roofing on buildings.

The roof plate element according to the invention has girders and the roofing element is designed with reduced height/thickness at an end part used for forming eaves. By means of simple technical measures substantial building project advantages are achieved which enable an architecturally very simple and light construction of the visible eave part of the roofing on buildings.

Suitably, the roof plate element according to the invention is designed such that the lowermost of the U-shaped metal sections are shorter than the uppermost of the U-shaped metal sections, and that the uppermost U-shaped sections are closed downwards at the end part to form eaves by means of U-shaped metal sections, which are disposed internally of the uppermost U-shaped metal sections and fastened thereto.

With the intention of transmitting the necessary forces between respective parts of box-shaped girders, the roof plate element according to the invention is advantageously designed so that the extreme end parts of the lowermost metal sections are connected with the uppermost metal sections by rectangular connecting sheets, preferably at both sides of the girders.

With the intention of increasing the rigidity of the girders, the roof plate element according to the invention is suitably designed so that the upper and lower metal sections at opposite ends and spaced along the entire length are provided with predominantly rectangular transverse bulkheads which are metal sheets with angular connecting flanges which are fastened preferably by screws to all three sides of the metal sections. n Suitably, the roof plate element according to the invention is designed so that the rectangular connecting sheets are disposed inside the metal sections, the transverse bulkheads are disposed opposite vertical sides of the connecting sheets, and the connecting sheets and bulkheads at the same time are connected with respective sides of the metal sections by screws.

For further increasing productivity in the production of the roof plate element according to the invention, it may be advantageous to design the roof plate element so that the rectangular connecting sheets are disposed inside the metal sections, the metal sections disposed inside the upper metal sections continue inwards beyond the connecting sheets, the transverse bulkhead is disposed opposite both vertical sides of connecting sheets, and the connecting sheets, bulkheads and internal metal sections at the same time are connected with respective sides of the metal sections by screws.

In order to further stabilize the rigidity of respective box-shaped girders, the roof plate element according to the invention is preferably designed so that the transverse bulkheads in respective metal sections are disposed opposite each other, and respective connecting flanges thereof are also interconnected.

With the object of facilitating anchoring the roof plate element according to the invention to building structures, it is advantageous to design the roof plate element to have a transverse opening opposite and proximate an innermost part of the end part which is intended for forming eaves.

BRIEF DESCRIPTION OF THE DRAWINGS

The invention is now explained more closely in connection with the drawing, in which.

DETAILED DESCRIPTION OF THE INVENTION

Figure 1:
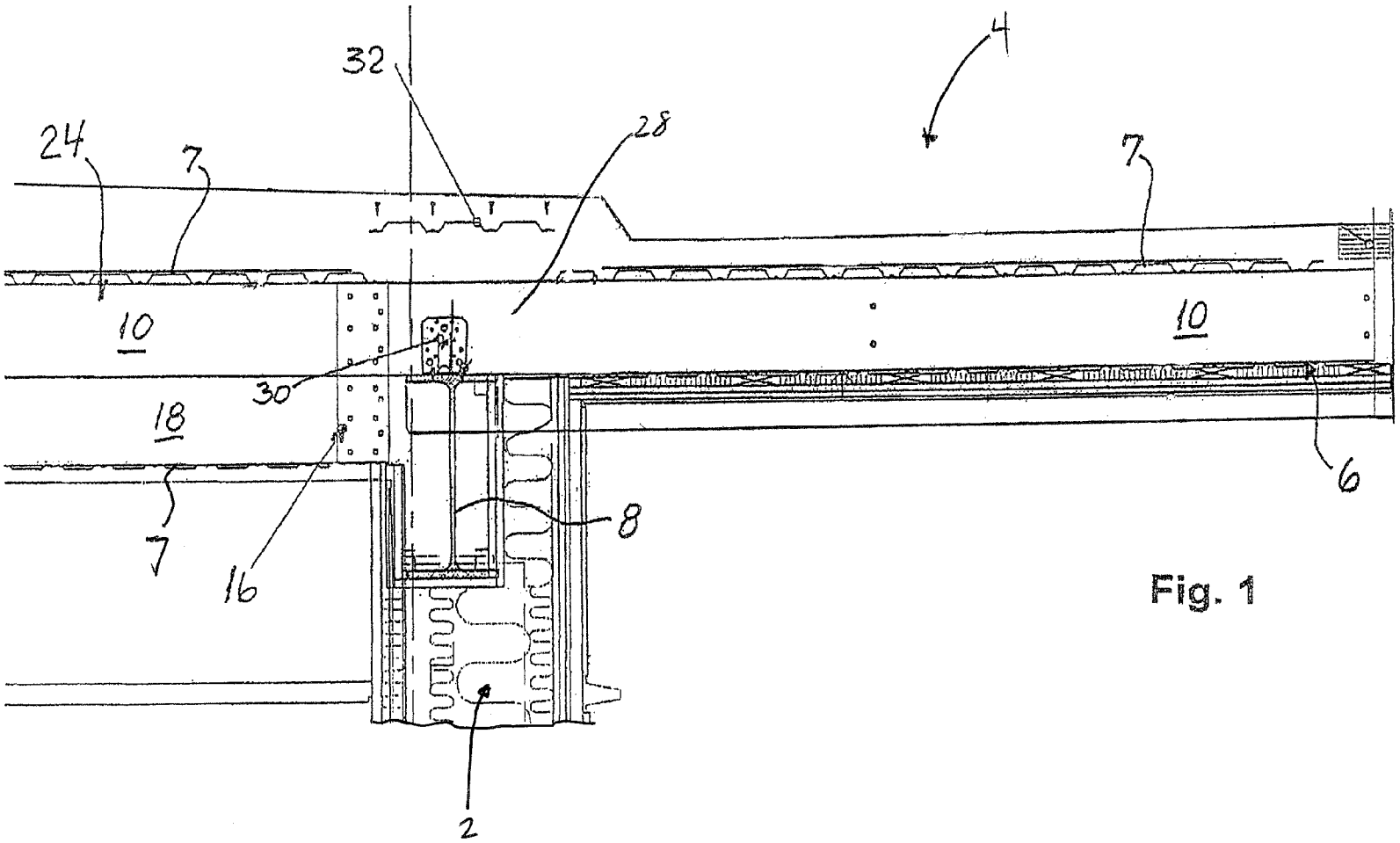
FIG. 1 shows a sectional view of a part of a roofing with an embodiment of a roof plate element according to the invention.
Figure 2:
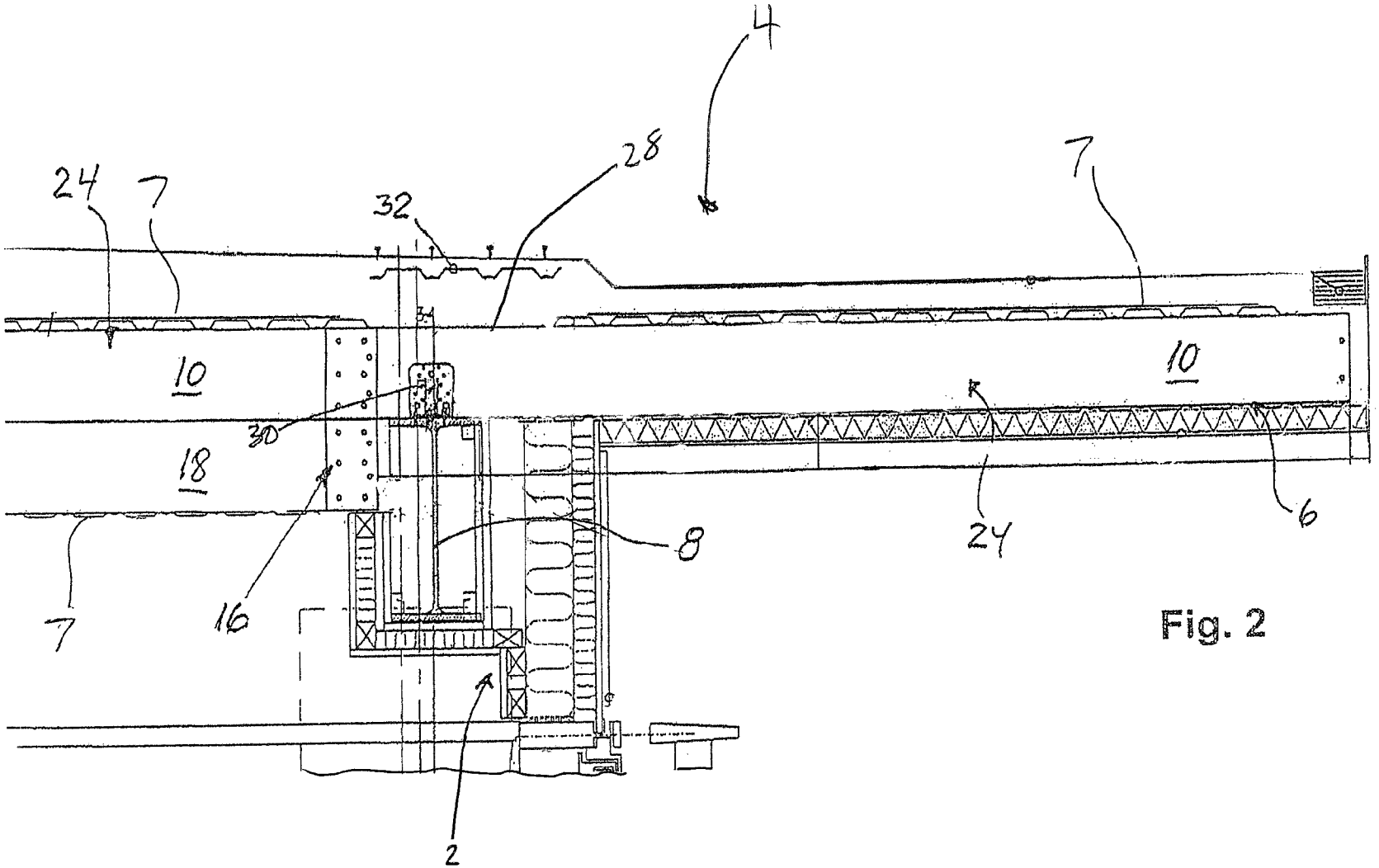
FIG. 2 shows a sectional view of a part of a roofing with a second embodiment of a roof plate element according to the invention.

FIGS. 1 and 2 show sectional views of a building 2 provided with embodiments of roof plate elements 4 according to the invention, where eaves 6 are established by means of roof plate elements 4 with reduced thickness/height from the edge of the building 2. The roof plate elements 4 according to the invention are spaced apart along the top surface (into the page) of the girder 8 to support the roof of the building. The roof plate elements 4 are supported and anchored on steel girders 8 in such a way that the roof plate elements 4 within the steel girders 8 have greater thickness/height than outside the steel girders 8.

As it also appears from FIGS. 1 and 2, the roof plate elements 4 opposite an innermost part of the end part which forms eaves 6 are designed with a transverse opening 28, through which it is possible to anchor roof plate elements 6 to girders 8, by means of prefabricated angle braces 30. Subsequently, the opening 28 is filled with insulating material as illustrated before mounting a loose cover plate 32 and covering with roofing material.

Figure 3:
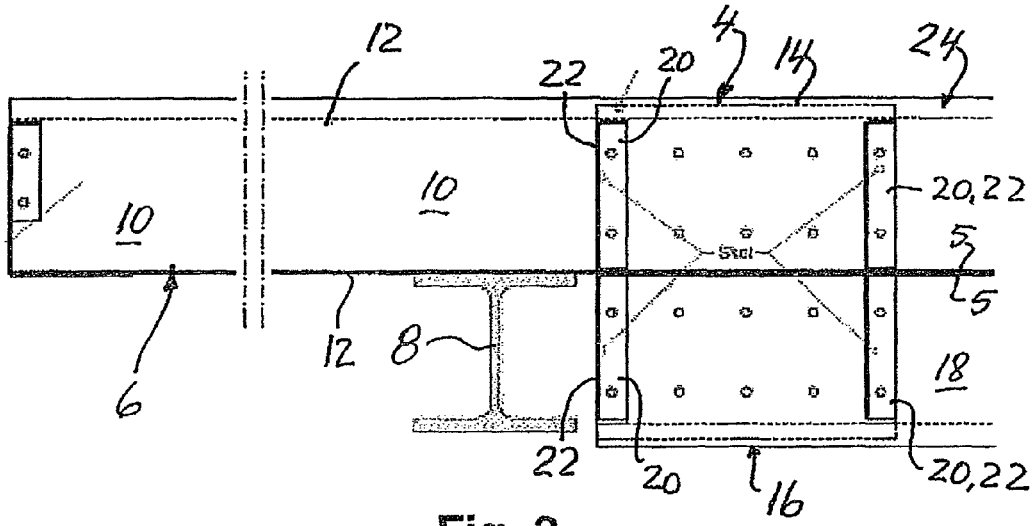
FIG. 3 shows an elementary sketch of a preferred embodiment of girders for a roof plate element according to the invention.
Figure 4:
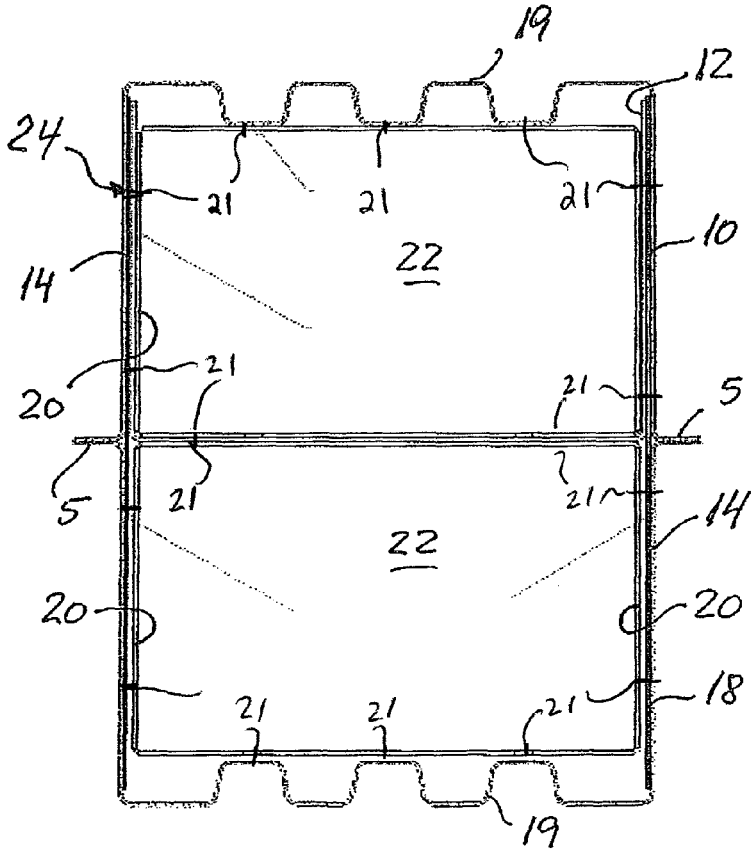
FIG. 4 shows a sectional view through the girder shown in FIG. 3 for illustrating its assembly for use in a roof plate element according to the invention.

FIGS. 3 and 4 show views of a roof plate element 4 which has eaves 6 with reduced thickness/height outside of a steel girder 8. The eaves 6 have an outer extended part of an upper U-shaped metal section 10 which is closed downwardly by a lower U-shaped metal section 12 disposed internally of the metal section 10, and which is disposed inwardly of internal rectangular connecting sheets 14.

An outer end 16 of a lower U-shaped metal section 18 is connected with the upper metal section 10 by the connecting sheets 14 and by angular connecting flanges 20 of traversing bulkheads 22, which are disposed opposite vertical side edges of the connecting sheets 14 so that the connection with the metal sections 10, 12, 18 and the connecting sheets 14 and the connecting flanges 20, respectively, may be established at once by means of screws 21 extending through these respective parts.

FIG. 4 shows most clearly that the upper and lower U-shaped metal sections 10, 18 which are interconnected at opposite outwardly bent lateral edges 5, for example, by means of clinching (press jointing) or in other ways. The lower and upper surfaces of the metal profiles 10, 18 are designed with trapezoidal profiling 19 which extends in the longitudinal direction of the girder. The connecting flanges 20 of the plate-shaped bulkheads 22 and the internal U-profile of metal section 12 are interconnected by screws 21.

Figure 5:
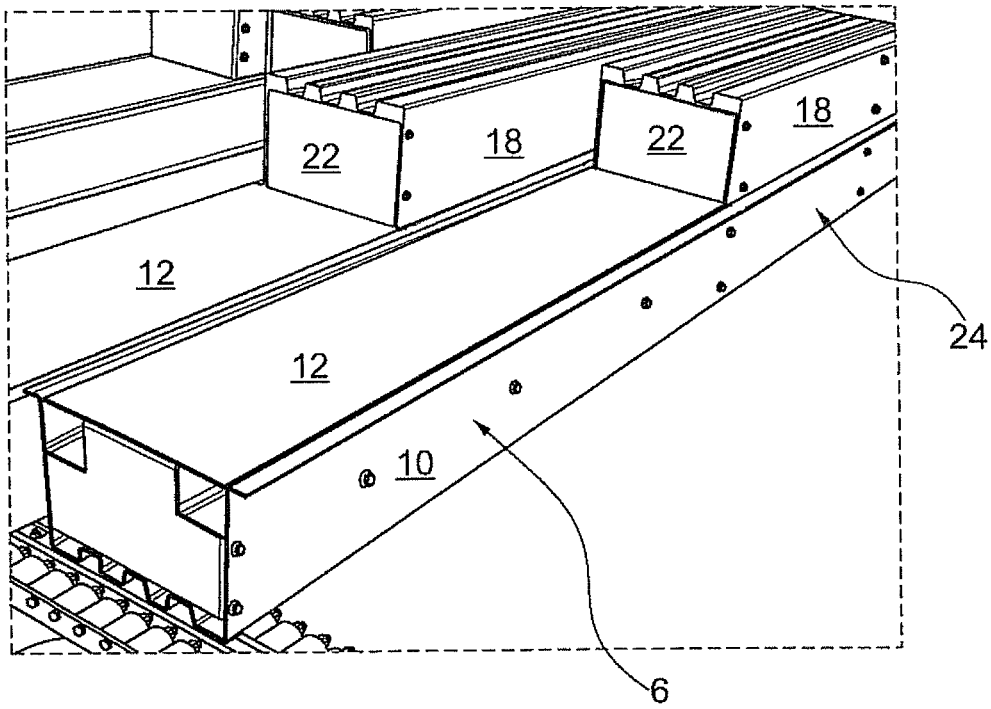
FIG. 5 shows a photographic view of an embodiment of a girder, for a roof plate element according to the invention.
Figure 6:
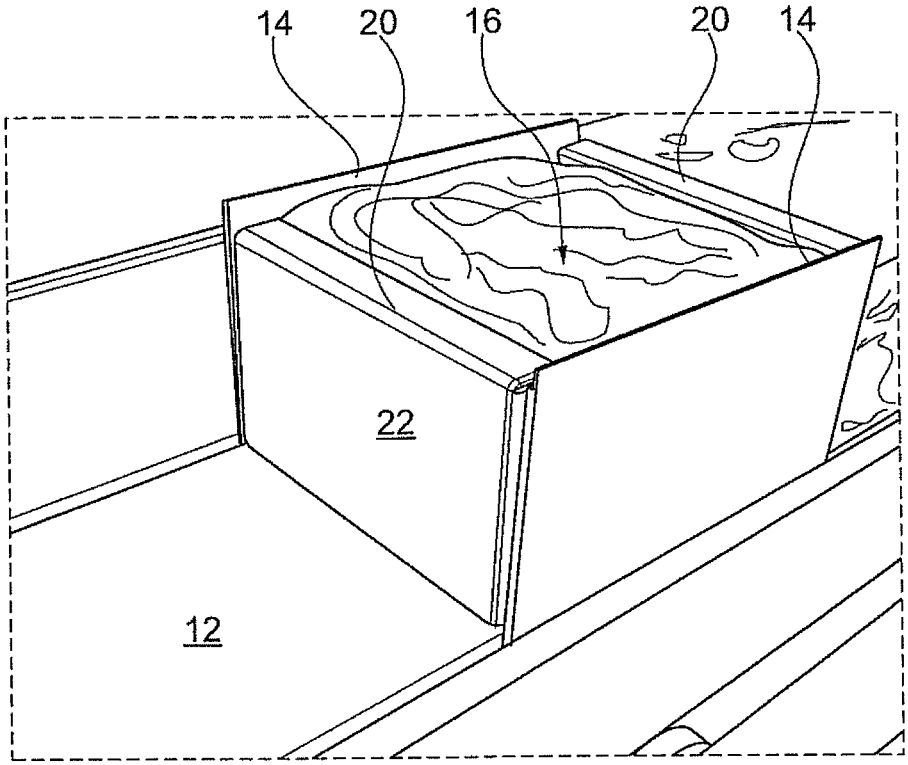
FIG. 6 shows a photographic view illustrating joint assembly details by manufacturing of a girder for at roof plate element according to the invention.

FIG. 5 show girders 24 during production which are shown with the top side facing downwards, so that the eaves 6, which are downwardly closed by the U-shaped metal section 12, are clearly seen. Photographic view 6 shows how the connecting sheets 14, during production of the girders 24, are disposed inside the girders 24.

Figure 7:
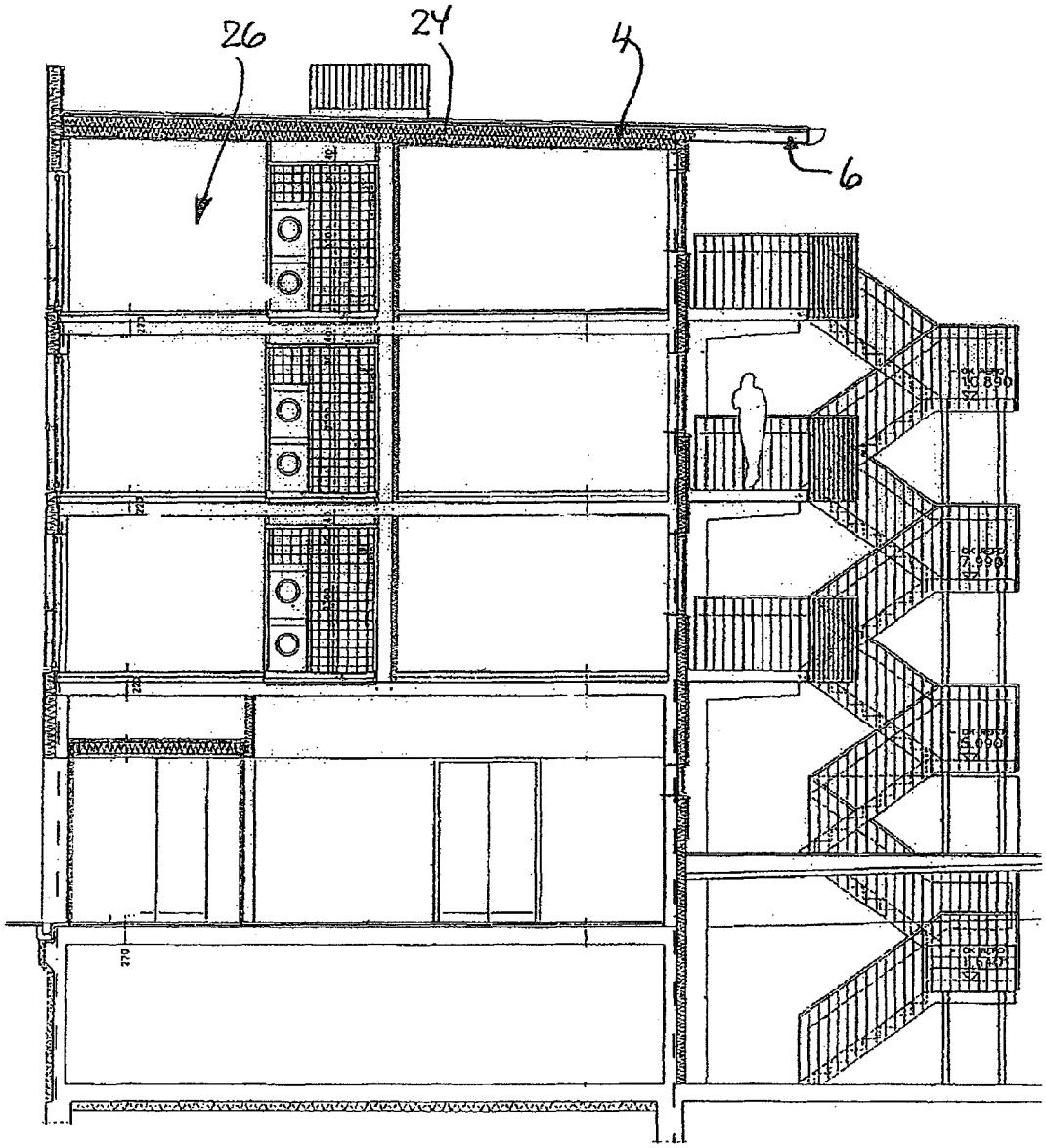
FIG. 7 shows a drawing of a building with a roofing with an embodiment for a roof plate element with eaves according to the invention.

FIG. 7 shows an example of a building 26 which is provided with eaves 6 according to the invention, and which provides outermost, light ending of at the roof plate elements.

With a roof plate element according to the invention, the lower parts of the metal profiles of the girders are not provided from the edge of the building, so that the eaves 6, the roof plate element and girders, respectively, have upper extended metal profiles with internal U-shaped metal sections which are closed downwardly. However, of course, there is nothing to hinder the roof plate element according to the invention from being reversed, so that the reduced thickness/height faces upwardly.

In that case, the lower U-shaped metal sections of the girders continue outwards and form the eaves themselves in such a way that the lower U-shaped metal sections of the girders, that is along the edge of the building, are suspended at outer end parts of the upper metal sections by the connecting sheets, etc. The upward facing reduced height/thickness of the roof plate element may thus suitably be used for forming an outwardly inclining roof gutter so that the roof plate element may be finished outwardly by an raised edge or end plate (sternplade).

Finally, it is to be noted that prefabricated roof plate according to the invention may have one or more girders 24, metal corrugated upper cover plates 7, insulation plates covered with asphalt roofing or film roofing. Such a roof plate element according to the invention may downwardly, for example, be covered with perforated, corrugated steel sheets that are secured directly at the bottom side of the girders 24, and which thereby form part of the roofing.

The invention claimed is:

1. A roof plate assembly for placement on a building as a prefabricated part of a roof of the building comprising:

hollow longitudinally extending girders disposed at sides of the roof plate assembly and at a position between the sides of the roof plate assembly, each girder including hollow upper and hollow lower longitudinally extending metallic sections which are stacked together with the upper section being above and joined to the lower section, the upper section including a U-shaped portion including a longitudinally extending opening facing upward toward a top of the assembly and the lower section including a U-shaped portion including a longitudinally extending opening facing downward toward a bottom of the assembly, metallic corrugations extending along the longitudinally extending openings, the corrugations of the upper section comprising an upper part of the assembly facing a top surface of the roof when the assembly is placed on a building and the lower section comprising a lower part of the assembly when the assembly is placed on the building; each U-shaped portion including two spaced apart sides extending away from the corrugations, a lateral edge extending outward from each of the sides of the U-shaped portions of the hollow upper and lower metallic longitudinally extending sections, the lateral the hollow upper and lower metallic longitudinally extending sections, the lateral edge of the hollow upper metallic longitudinally extending section being connected to the lateral edge of the hollow lower metallic longitudinally extending section of each girder to join the U-shaped sections together, and upper and lower metallic sheets are respectively disposed above the upper girders and below the lower girders which extend transversely to the metallic corrugations and are coupled to the girders to fix the metallic sheets to the upper and lower girders to form the assembly.

2. A roof plate in accordance with claim 1 wherein:

each surface comprises a longitudinally extending bent edge;

the bent edges are joined; and the upper plate has corrugations extending transversely to the corrugations extending along the longitudinally extending openings.

3. A roof plate in accordance with claim 2 wherein:

the hollow lower metallic longitudinally extending section with a lesser length of each girder is closed at an end part by a metallic section which is disposed internally relative to the another one of the hollow metallic sections.

4. A roof plate in accordance with claim 3 wherein:

the hollow lower metallic longitudinally extending section of a girder includes an end plate connected to the hollow upper metallic section of the girder by a metallic connecting sheet.

5. A roof plate in accordance with claim 4 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

6. A roof plate in accordance with claim 3 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

7. A roof plate in accordance with claim 2 wherein:

the hollow lower metallic longitudinally extending section of a girder includes an end plate connected to the hollow upper metallic section of the girder by a metallic connecting sheet.

8. A roof plate in accordance with claim 7 wherein:

the connecting sheets of each girder are connected to sides of the girder.

9. A roof plate in accordance with claim 8 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

10. A roof plate in accordance with claim 7 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

11. A roof plate in accordance with claim 2 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

12. A roof plate assembly in accordance with claim 1 wherein:

the hollow lower metallic longitudinally extending section of each girder has a length less than a length of the hollow upper metallic longitudinally extending section to which the hollow lower metallic longitudinally extending section is joined by the lateral edges, the upper metallic longitudinally extending section forms an extension of the roof plate assembly beyond the lower metallic longitudinally extending section which forms an eave of the building when the roof plate assembly is assembled on the building so that the lower metallic longitudinally extending section is supported by the building and the upper metallic longitudinally extending section extends away from the building to form the eave.

13. A roof plate in accordance with claim 12 wherein:

the hollow lower metallic longitudinally extending section with a lesser length of each girder is closed at an end part by a metallic section which is disposed internally relative to the another one of the hollow metallic sections.

14. A roof plate in accordance with claim 13 wherein:

the hollow lower metallic longitudinally extending section of a girder includes an end plate connected to the hollow upper metallic longitudinally extending section of the girder by a metallic connecting sheet.

15. A roof plate in accordance with claim 14 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

16. A roof plate in accordance with claim 14 wherein:

the connecting sheets of each girder are connected to sides of the girder.

17. A roof plate in accordance with claim 16 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

18. A roof plate in accordance with claim 14 wherein:

each connecting sheet is disposed inside of the hollow upper and lower longitudinally extending metallic sections.

19. A roof plate in accordance with claim 16 wherein:

each connecting sheet is disposed inside the hollow upper and hollow lower longitudinally extending metallic sections.

20. A roof plate in accordance with claim 19 wherein:

a metallic sheet is disposed inside the hollow upper metallic longitudinally extending section and continues inward beyond the connecting sheets.

21. A roof plate in accordance with claim 14 wherein:

metallic bulkheads are disposed adjacent vertical sides of the connecting sheet, a metallic sheet is disposed inside the hollow upper and hollow lower metallic longitudinally extending section, and the metallic bulkheads are connected along the sides of the hollow upper and lower metallic sections by screws.

22. A roof plate in accordance with claim 13 wherein:

the hollow lower metallic longitudinally extending section of a girder includes an end plate connected to the hollow upper metallic longitudinally extending section of the girder by a metallic connecting sheet.

23. A roof plate in accordance with claim 22 wherein:

the connecting sheets of each girder are connected to sides of the girder.

24. A roof plate in accordance with claim 23 wherein:

the connecting sheets of each girder are connected to sides of the girder.

25. A roof plate in accordance with claim 13 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

26. A roof plate in accordance with claim 22 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

27. A roof plate in accordance with claim 23 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

28. A roof plate in accordance with claim 12 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

29. A roof plate in accordance with claim 1 wherein:

each girder comprises spaced apart metallic bulkheads located at opposite ends and spaced along a length of the girder, each bulkhead includes a sheet with connecting flanges fastened to the hollow upper and lower metallic longitudinally extending sections.

30. A roof plate in accordance with claim 1 comprising:

an opening located in a part of the hollow upper metallic sections where the hollow upper and hollow lower sections are coextensive.

31. A roof plate in accordance with claim 1 wherein:

each U-shaped portion is closed with a metal section and the metal sections closing each U-shaped portion face each other.

32. A roof plate in accordance with claim 31, wherein:

the metal sections closing the U-shaped portion are in contact with each other.

* * * * *